United States Patent [19]

Koga

[11] Patent Number: 4,888,034

[45] Date of Patent: Dec. 19, 1989

[54] CHOKE DEVICE FOR INTERNAL COMBUSTION ENGINE

[75] Inventor: Hiroaki Koga, Fuchu, Japan

[73] Assignee: Kioritz Corporation, Tokyo, Japan

[21] Appl. No.: 295,798

[22] Filed: Jan. 11, 1989

[30] Foreign Application Priority Data

Feb. 25, 1988 [JP] Japan ..... 63-23073[U]

[51] Int. Cl.[4] ..... F02M 19/00

[52] U.S. Cl. ..... 55/260; 261/64.6; 55/DIG. 28

[58] Field of Search ..... 261/64.6; 55/260, DIG. 28

[56] References Cited

U.S. PATENT DOCUMENTS 3,746,320 7/1973 Van Camp et al. ..... 261/35
3,811,417 5/1974 Keenan et al. ..... 55/DIG. 28
3,852,377 12/1974 Heintzelman et al. ..... 55/DIG. 28
4,450,933 5/1984 Fukuoka et al. ..... 181/229

FOREIGN PATENT DOCUMENTS 26-10807 9/1951 Japan .
33-17602 10/1958 Japan .
34-19609 12/1959 Japan .
34-20505 12/1959 Japan .

*Primary Examiner*—Tim Miles
*Attorney, Agent, or Firm*—Browdy and Neimark

[57] ABSTRACT

A choke device for an internal combustion engine. A choke plate formed with an opening capable of aligning with a suction port of a venturi of a carburetor is slidably supported for opening and closing the suction port. Legs of a suitable length which rise outwardly from the periphery of the opening, and a blow-back prevention plate provided on the tip of the legs and extending in parallel with the choke plate are provided on the outer surface of the choke plate in such a manner as to form an integral structure therewith.

3 Claims, 1 Drawing Sheet

CHOKE DEVICE FOR INTERNAL COMBUSTION ENGINE

BACKGROUND OF THE INVENTION

The present invention relates to a choke device which may be used in, for instance, two-cycle internal combustion engines.

Certain internal combustion engines, in particular, piston-valve-type two-cycle internal combustion engines, which have no valve provided in the intake system, generally experience a considerable degree of fuel blow-back and, hence, encounter various secondary drawbacks. In order to overcome this problem, an arrangement has hitherto been used in which a blow-back prevention plate is provided upstream of the suction port of a venturi of the carburetor, so as to prevent any blow-back of the fuel and to allow any fuel blown back to be sucked into the engine again. The known arrangement also has a pivotable choke valve disposed separately for the purpose of restricting the amount of air sucked at the time of engine starting.

With the known arrangement of choke devices for internal combustion engines, however, since the separate blow-back prevention plate is mounted upstream of the venturi, and the choke valve is provided separately therefrom, the entire structure of the carburetor is complicated, requires a number of parts, and calls for considerable amounts of labor and expenditure during such operations as the assembly thereof.

SUMMARY OF THE INVENTION

The present invention has been accomplished to eliminate the above-state problems of the prior art. An object of the present invention is to provide a choke device for an internal combustion engine in which a choke valve is disposed at the suction port of the carburetor of the engine and a blow-back prevention plate is provided in such a manner that the valve and the plate form an integral structure, the choke device thus enabling simplification of the entire structure, a reduction in the number of parts required, and easy and low-cost production and assembly.

According to the present invention, there is provided a choke device for an internal combustion engine, such as a two-cycle internal combustion engine, comprising: a choke plate formed with an opening capable of aligning with the suction port of a venturi of the carburetor of the engine and slidably supported for opening and closing the suction port; legs of a suitable length which rise outwardly from the periphery of the opening; and a blow-back prevention plate provided on the tip of the legs and extending in parallel with the choke plate, the legs and the blow-back prevention plate being provided on the outer surface of the choke plate in such a manner as to form an integral structure therewith.

With the above-stated arrangement of the choke device of the present invention, the choke plate slides to open and close the suction port of the venturi, and any fuelblown back through the suction port collides with the blow-back prevention plate provided in an integral manner on the outer surface of the choke plate, thereby being prevented from scattering any further. During the next suction stroke of the engine, the fuel is again sucked into the venturi and is then delivered to the engine.

PREFERRED EMBODIMENT OF THE INVENTION

The present invention will be described hereunder with respect to one embodiment thereof.

Figure 1:
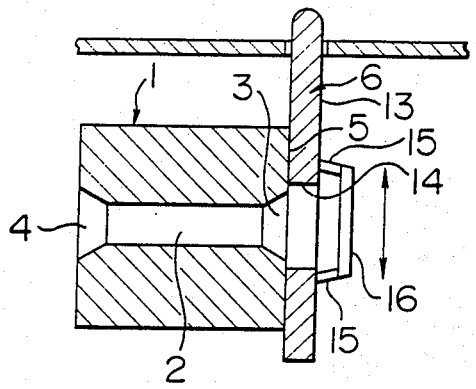
FIG. 1 is a cross-sectional view schematically showing essential parts of a choke device for an internal combustion engine, in accordance with one embodiment of the present invention.
Figure 2:
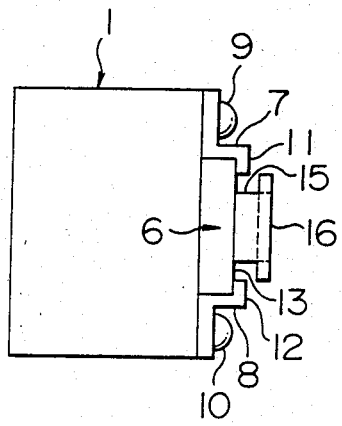
FIG. 2 is a side view of the device shown in FIG. 1.

Referring to FIGS. 1 and 2 schematically illustrating one embodiment, a carburetor 1 has a venturi 2 formed therein. The venturi 2 has a suction port 3 at which the venturi 2 is connected to an air cleaner (not shown) to suck clean air through the suction port 3. The venturi 2 also has a discharge port 4 which is connected to the suction port (not shown) of, for instance, a piston-valve-type two-cycle internal combustion engine. Thus, the carburetor 1 is arranged such that a mixture of fuel and air formed by injecting fuel into the air sucked into the venturi 2 is supplied to the internal combustion engine through the discharge port 4.

A choke plate 6 is mounted on the outer surface 5 of the suction port 3 of the carburetor 1 in such a manner as to be slidable horizontally across the suction port 3. A pair of slender guide members 7 and 8, each bent in a stepped manner, are fixed to the outer surface 5 of the suction port 3 by screws 9 and 10, respectively, and they extend in parallel with each other on the upper and lower sides of the port 3. The guide members 7 and 8 guide the upper and lower sides of the choke plate 6 as the choke plate 6 slides across the suction port 3 in the vertical direction, as viewed in FIG. 1. The projecting end portions 11 and 12 of the guide members 7 and 8, respectively, are bent toward each other and engage with the outer surface 13 of the choke plate 6, thereby holding the choke plate 6 in such a manner as to prevent any dismounting of the choke plate 6 from the outer surface 5 of the suction port 3.

Figure 3:
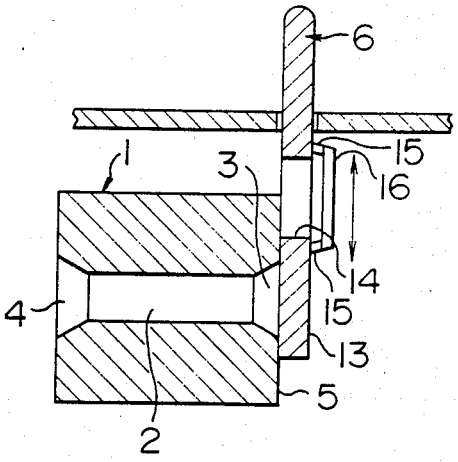
FIG. 3 is a cross-sectional view corresponding to FIG. 1, showing a different state of the device.

The choke plate 6 is formed with an opening 14 capable of aligning with the suction port 3 of the venturi 2. When the engine is in operation, the choke plate 6 is maintained at an open position thereof, shown in FIG. 1, at which the opening 14 is aligned with the suction port 3. At the time of engine starting, the choke plate 6 is slid to one side and is maintained at a close position thereof, shown in FIG. 3, at which the suction port 3 is closed thereby. Further, the choke plate 6 can be slid to a suitable position between the open position and the close position in accordance with the operating condition of the engine, thereby enabling the opening of the suction port 3 to be adjusted.

A plurality of legs 15 of a suitable length which rise outwardly from the periphery of the opening 14, and a disk- shaped blow-back prevention plate 16 provided on the tip of the legs 15 and having a diameter slightly larger than that of the opening 14 are provided on the outer surface 13 of the choke plate 6 in such a manner as to form an integral structure therewith. By virtue of this arrangement, the blow-back prevention plate 16 is disposed in opposition to the opening 14 with a suitable space therebetween and in parallel with the choke plate 6. Therefore, any fuel blown back through the suction port 3 of the venturi 2 then through the opening 14 formed in the choke plate 6 collides with the blow-back prevention plate 16, thereby being prevented from scattering any further. During the next suction stroke of the engine, the fuel is again sucked through the opening 14 into the venturi 2 then into the internal combustion engine.

The choke plate, the legs, and the blow-back prevention plate may preferably be formed as an integral structure by stamping of a single thin steel plate, or by using a synthetic resin material.

What is claimed is:

1. A choke device for an internal combustion engine comprising: a choke plate formed with an opening capable of aligning with a suction port of a venturi of the carburetor of said engine and slidably supported for opening and closing said suction port; legs of a suitable length which rise outwardly from the periphery of said opening; and a blow-back prevention plate provided on the tip of said legs and extending in parallel with said choke plate, said legs and said blow-back prevention plate being provided on an outer surface of said choke plate in such a manner as to form an integral structure therewith.

2. A choke device according to claim 1, wherein said choke plate, said legs, and said blow-back prevention plate are formed as an integral structure using a single thin steel plate.

3. A choke device according to claim 1, wherein said choke plate, said legs, and said blow-back prevention plate are formed as an integral structure using a synthetic resin material.

* * * * *